US010584546B1

(12) United States Patent
Ford

(10) Patent No.: US 10,584,546 B1
(45) Date of Patent: Mar. 10, 2020

(54) ROTATOR APPARATUS AND METHOD THEREFOR

(71) Applicant: Michael Brent Ford, St. George, UT (US)

(72) Inventor: Michael Brent Ford, St. George, UT (US)

( * ) Notice: Subject to any disclaimer, the term of this patent is extended or adjusted under 35 U.S.C. 154(b) by 0 days.

(21) Appl. No.: 16/372,901

(22) Filed: Apr. 2, 2019

(51) Int. Cl.
*E21B 17/10* (2006.01)
*E21B 33/04* (2006.01)

(52) U.S. Cl.
CPC ..... *E21B 17/1071* (2013.01); *E21B 33/0415* (2013.01)

(58) Field of Classification Search
CPC . E21B 17/1071; E21B 33/0415; E21B 43/126
See application file for complete search history.

(56) References Cited

U.S. PATENT DOCUMENTS 1,749,722 A * 3/1930 Stevens ..... E21B 1/02 74/21
5,787,981 A * 8/1998 Taylor ..... E21B 4/006 166/237
7,946,348 B2 * 5/2011 Swinford ..... E21B 17/073 166/117.7
10,167,707 B2 * 1/2019 Trapani ..... E21B 43/127
10,221,644 B2 * 3/2019 Swinford ..... E21B 31/18
2013/0181844 A1 7/2013 Hurst et al.

OTHER PUBLICATIONS

Weatherford, "Weatherford: Intelligent Rod Rotator," YouTube, Mar. 20, 2014, https://www.youtube.com/watch?v=XDpfH5kEhxY&feature=youtu.be.

* cited by examiner

*Primary Examiner* — Matthew R Buck
(74) *Attorney, Agent, or Firm* — Weiss & Moy, P.C.; Karen J. S. Fouts

(57) ABSTRACT

A rotator apparatus for rotating a plunger, traveling barrel, valve rod, or sucker rod of a pumping system. The apparatus is adapted to be coupled to various downhole pump components and positioned within the wellbore. In one embodiment, the rotator apparatus includes a north coupling component, a piston, a cage, and a south coupling component. In an embodiment, the piston may include a plurality of flutes, which are formed so as to impart cyclonic rotation on fluids passing into the interior of the piston. On each downstroke and upstroke, the piston rotates an increment, causing the south coupling component and plunger, traveling barrel, valve rod, or sucker rod to rotate an increment. The rotation imparted on the plunger, traveling barrel, valve rod, or sucker rod redistributes the solids present in the fluid, preventing accumulation of the solids and constant wear in one particular area of the plunger and/or barrel.

20 Claims, 6 Drawing Sheets

ROTATOR APPARATUS AND METHOD THEREFOR

FIELD OF THE INVENTION

The present invention generally relates to oil pumps and rotators used therein and, more specifically, to a rotator apparatus that may be positioned on top of a pump plunger, a traveling barrel, a valve rod, or a sucker rod within the well tubing, and related method therefor.

BACKGROUND OF THE INVENTION

In general terms, an oil well pumping system begins with an above-ground pumping unit, which creates the up and down pumping action that moves the oil (or other substance being pumped) out of the ground and into a flow line, from which the oil is taken to a storage tank or other such structure.

Below ground, a shaft or "wellbore" is lined with piping known as "casing." Into the casing is inserted piping known as "tubing." A sucker rod, which is ultimately, indirectly coupled at its north end to the above-ground pumping unit is inserted into the tubing. The sucker rod is coupled at its south end indirectly to the subsurface oil pump itself, which is also located within the tubing, which is sealed at its base to the tubing. The sucker rod couples to the oil pump at a coupling known as a 3-wing cage. The subsurface oil pump has a number of basic components, including a barrel and a plunger. The plunger operates within the barrel, and the barrel, in turn, is positioned within the tubing. The north end of the plunger is typically connected to a valve rod or hollow valve rod, which moves up and down to actuate the pump plunger. The valve rod or hollow valve rod typically passes through a valve rod guide.

Beginning at the south end, subsurface oil pumps generally include a standing valve, which has a ball therein, the purpose of which is to regulate the passage of oil (or other substance being pumped) from downhole into the pump, allowing the pumped matter to be moved northward out of the system and into the flow line, while preventing the pumped matter from dropping back southward into the hole. Oil is permitted to pass through the standing valve and into the pump by the movement of the ball off of its seat, and oil is prevented from dropping back into the hole by the seating of the ball.

North of the standing valve, coupled to the sucker rod, is a traveling valve. The purpose of a conventional traveling valve is to regulate the passage of oil from within the pump northward in the direction of the flow line, while preventing the pumped oil from slipping back down in the direction of the standing valve and hole.

In use, oil is pumped from a hole through a series of "downstrokes" and "upstrokes" of the oil pump, wherein these motions are imparted by the above-ground pumping unit. During the upstroke, formation pressure causes the ball in the standing valve to move upward, allowing the oil to pass through the standing valve and into the barrel of the oil pump. This oil will be held in place between the standing valve and the traveling valve. In the conventional traveling valve, the ball is located in the seated position. It is held there by the pressure from the oil that has been previously pumped. The oil located above the traveling valve is moved northward in the direction of the 3-wing cage at the end of the oil pump.

During the downstroke, the ball in the conventional traveling valve unseats, permitting the oil that has passed through the standing valve to pass therethrough. Also during the downstroke, the ball in the standing valve seats, preventing the pumped oil from slipping back down into the hole.

The process repeats itself again and again, with oil essentially being moved in stages from the hole, to above the standing valve and in the oil pump, to above the traveling valve and out of the oil pump. As the oil pump fills, the oil passes through the 3-wing cage and into the tubing. As the tubing is filled, the oil passes into the flow line, from which the oil is taken to a storage tank or other such structure.

In a tubing pump, the barrel assembly is coupled to and becomes a part of the well tubing at the bottom of the well. Tubing pumps are typically designed for pumping relatively large volumes of fluid, as compared with smaller pumps, such as insert pumps. With a tubing pump, the well tubing must be removed from the well in order to service the pump barrel. Alternatively, with an insert pump, the barrel assembly is a separate component from the well tubing. With an insert pump, the complete pump is attached to the sucker rod string and is inserted into the well tubing with the sucker rod string. As a complete unit, an insert pump may be inserted and pulled out of the well without removing the well tubing.

There are a number of problems that are regularly encountered during oil pumping operations. Oil that is pumped from the ground is generally impure, and includes water, gas, and solid impurities such as sand and other debris. During pumping operations, the presence of solids in the well fluids can cause major damage to the pump plunger and the barrel, as well as to other pump components, thus reducing the run cycle of the pump, reducing revenue to the pump operator, and increasing expenses. For example, during pumping operations, solids can become trapped and accumulate between the barrel and plunger, between which there is only an extremely narrow tolerance. This can create scarring and damage to the plunger and/or barrel. In particular, solids may accumulate in a direct channel in the pump plunger and/or the barrel, due to the repetitive up and down motion of the pump. With typical pump designs, solids tend to scar the plunger and/or barrel over time, which causes the solids to continually migrate and eventually completely cut through the length of the plunger. Once this occurs, the fluid seal formed between the plunger and barrel is unable to hold back fluid, causing leakage and requiring replacement of the plunger and/or barrel.

One solution to address this problem has been to provide rod rotation tools that rotate the sucker rod during pumping operations. Presently known rod rotation tools suffer from several shortcomings in various areas of the design. For example, presently known rod rotation tools are typically placed at the surface, on the above-ground pumping unit (also known as a "pumpjack"). Such tools typically rotate the complete rod string, which, in turn, will eventually rotate the plunger. This method has been successful in vertical wells, where the drill hole/wellbore is somewhat vertical to the horizon. However, problems arise when this method is used in deviated wells, as discussed further herein.

Unlike typical wellbores of the past, which are typically drilled in relatively straight vertical lines, a current drilling trend is for wellbores to be drilled vertically in part and then horizontally in part, resulting in wellbores that have some curvature or "deviation." Such wells may commonly be referred to as "deviated" wells. When drilling deviated wells, drillers typically drill vertically for some distance (e.g. one mile), through the upper zone and down to the bedrock, and then transition to drilling horizontally. One advantage to drilling wellbores in this configuration is that the horizontal area of the well typically has many more perforations in the casing, which allows for more well fluid to enter the wellbore than with typical vertical casing wells. This, in turn, allows for more well fluid to be pumped to the surface.

There are a number of problems that may be encountered with deviated wells. Horizontal wells may typically be drilled at an angle of roughly ten to twelve degrees over roughly 1000 feet to allow for a gradual slope. This results in approximately one degree of deviation for every 100 feet. A problem that occurs when drilling such wells, particularly when they are drilled relatively fast, is that the wells are not drilled perfectly, resulting in crooked wellbores. Such wells may have many slight to extreme deviations in the drill hole, which would create a non-linear configuration. When the deviated well is completed to depth, the drill pattern is positioned horizontally to drill. The pump then must be lowered from the surface through all of the deviations of the wellbore down to the horizontal section of the well where it would be placed in service. The pump could be positioned and operated within a deviation (curve) or possibly in the horizontal area of the well. Where the pump is operated in such a non-vertical configuration, use of presently known rod rotation tools can cause the rods to bind up in the tubing, preventing rotation of the pump plunger, potentially causing damage and inefficiency, and requiring replacement of pump components.

The present invention addresses these problems encountered in prior art pumping systems, and provides other, related, advantages.

SUMMARY

In accordance with one embodiment of the present invention, a rotator apparatus is disclosed. The rotator apparatus comprises, in combination: a north coupling component having an upper region and a lower region, the upper region having an upper channel formed therethrough and the lower region having a lower channel formed therethrough, wherein the upper channel and the lower channel form a continuous passageway; a piston having an upper region, a lower region, and a channel formed therethrough; wherein the upper region of the piston is adapted to be reciprocally positioned in the lower channel of the north coupling component; wherein the piston has a plurality of openings and a plurality of locator pins located in the lower region, wherein each of the plurality of locator pins is positioned in one of each of the plurality of openings; a cage having an upper region, a lower channel region, and a channel formed therethrough; wherein the channel region has a plurality of channels adapted to receive the plurality of locator pins; wherein the cage is adapted to reciprocally receive the piston and to be coupled at its upper region to the lower region of the north coupling component; wherein the piston is capable of north, south, and rotational movement relative to the cage; wherein an interior surface of the cage and an exterior surface of the piston define at least one fluid cavity therebetween; and a south coupling component having an upper region, a lower region, and a channel formed therethrough, and adapted to be coupled at its upper region to the lower region of the piston.

In accordance with another embodiment of the present invention, a rotator apparatus is disclosed. The rotator apparatus comprises, in combination: a north coupling component having an upper region and a lower region, the upper region having an upper channel formed therethrough and the lower region having a lower channel formed therethrough, wherein the upper channel and the lower channel form a continuous passageway; wherein the lower region of the north coupling component has an exterior threaded region; a piston having an upper region, a bushing, a lower region, and a channel formed therethrough; wherein the upper region of the piston is adapted to be reciprocally positioned in the lower channel of the north coupling component; wherein the lower region of the piston has an exterior threaded region; wherein the piston has a plurality of openings and a plurality of locator pins located in the lower region, wherein each of the plurality of locator pins is positioned in one of each of the plurality of openings; a cage having an upper region, a lower channel region, and a channel formed therethrough; wherein the upper region of the cage has an interior threaded region, adapted to be threadably coupled with the exterior threaded region at the lower region of the north coupling component; wherein the channel region has a plurality of channels adapted to receive the plurality of locator pins; wherein the cage is adapted to reciprocally receive the piston and to be coupled at its upper region to the lower region of the north coupling component; wherein the piston is capable of north, south, and rotational movement relative to the cage; wherein an interior surface of the cage and an exterior surface of the piston define a plurality of fluid cavities therebetween; and a south coupling component having an upper region, a lower region, and a channel formed therethrough, and adapted to be coupled at its upper region to the lower region of the piston; and wherein the upper region of the south coupling component has an interior threaded region, adapted to be threadably coupled with the exterior threaded region at the lower region of the piston.

In accordance with another embodiment of the present invention, a method for rotating a pump component is disclosed. The method comprises the steps of: providing a rotator apparatus comprising, in combination: a north coupling component having an upper region and a lower region, the upper region having an upper channel formed therethrough and the lower region having a lower channel formed therethrough, wherein the upper channel and the lower channel form a continuous passageway, a piston having an upper region, a bushing, a lower region, and a channel formed therethrough; wherein the upper region of the piston is adapted to be reciprocally positioned in the lower channel of the north coupling component; wherein the piston has a plurality of openings and a plurality of locator pins located in the lower region, wherein each of the plurality of locator pins is positioned in one of each of the plurality of openings; a cage having an upper region, a lower channel region, and a channel formed therethrough; wherein the channel region has a plurality of channels adapted to receive the plurality of locator pins; wherein the cage is adapted to reciprocally receive the piston and to be coupled at its upper region to the lower region of the north coupling component; wherein the piston is capable of north and south and rotational movement relative to the cage; wherein an interior surface of the cage and an exterior surface of the piston define an upper fluid cavity and a lower fluid cavity therebetween; and a south coupling component having an upper region, a lower region, and a channel formed therethrough, and adapted to be coupled at its upper region to the lower region of the piston; coupling the rotator apparatus at its south coupling component to at least one pump component; causing the piston to move in a northward direction relative to the cage; during the movement of the piston in the northward direction, causing the piston to rotate an increment; during the movement of the piston in the northward direction, causing the south coupling component and the at least one pump component to rotate an increment during the incremental rotation of the piston; causing the piston to move in a southward direction relative to the cage; during the movement of the piston in the southward direction, causing the piston to rotate an increment; and during the movement of the piston in the southward direction, causing the south coupling component and the at least one pump component to rotate an increment during the incremental rotation of the piston.

BRIEF DESCRIPTION OF THE DRAWINGS

The present application is further detailed with respect to the following drawings. These figures are not intended to limit the scope of the present application, but rather, illustrate certain attributes thereof.

DETAILED DESCRIPTION OF THE INVENTION

Figure 1:
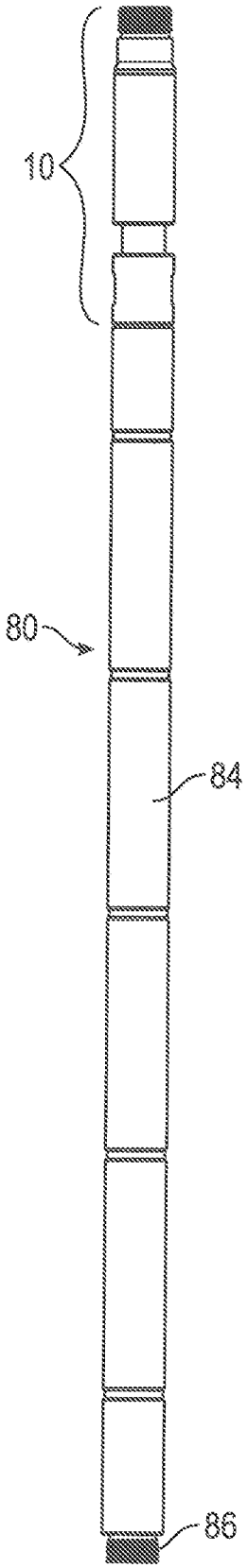
FIG. 1 is a side view of an embodiment of a rotator apparatus in accordance with one or more aspects of the present invention, wherein a southern end of the rotator apparatus is shown coupled to a northern end of a pump plunger.
Figure 2:
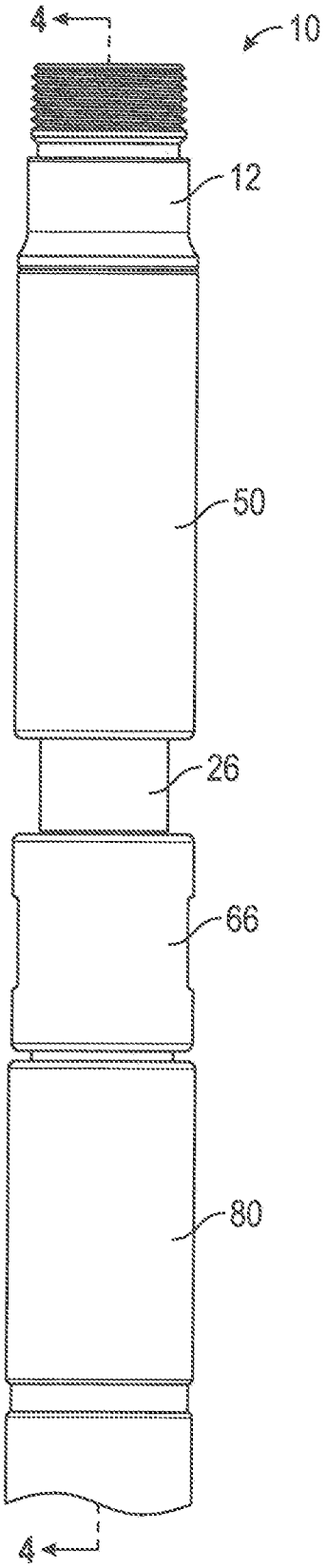
FIG. 2 is a side view of the rotator apparatus of FIG. 1, wherein a southern end of the rotator apparatus is shown coupled to a northern end of a pump plunger.

The description set forth below in connection with the appended drawings is intended as a description of presently preferred embodiments of the disclosure and is not intended to represent the only forms in which the present disclosure may be constructed and/or utilized. The description sets forth the functions and the sequence of steps for constructing and operating the disclosure in connection with the illustrated embodiments. It is to be understood, however, that the same or equivalent functions and sequences may be accomplished by different embodiments that are also intended to be encompassed within the spirit and scope of this disclosure.

FIGS. 1-10, together, disclose embodiments of a rotator apparatus 10 of the present invention. The rotator apparatus 10 is adapted to be used with a pumping system, such as an oil pumping system, that is positioned within a pump barrel. The rotator apparatus 10 may be employed with pumps of various configurations, including rod/insert pumps and tubing pumps. With respect to rod/insert pumps, such pump configurations may include, for example: stationary pumps (pumps having a moving plunger and a stationary working barrel); or traveling barrel pumps (pumps having a moving working barrel and a stationary plunger). Further, with respect to stationary rod pumps, such pump configurations may include, for example, top anchor or bottom anchor pumps. The rotator apparatus 10 is adapted to cause various pump components, including a plunger, a traveling barrel, a valve rod, or a sucker rod to rotate during oil pumping operations. Although the term "oil" is used herein, it should be understood that the rotator apparatus 10 of the present invention may be used in pumping systems that pump fluids other than oil, such as debris-containing water. In describing the structure of the rotator apparatus 10 and its operation (as well as other pump components discussed herein), the terms "north" and "south" are utilized. The term "north" is intended to refer to that end of the pumping system that is more proximate the pumping unit, while the term "south" refers to that end of the system that is more distal the pumping unit, or "downhole."

Referring to FIGS. 1-4B, an embodiment of the rotator apparatus 10 of the present invention is shown. Beginning from the north end, the rotator apparatus 10, which has a substantially cylindrical external configuration, may generally comprise the following components: a north coupling component 12, a piston 26, a cage 50, and a south coupling component 66. The rotator apparatus 10 may be coupled at its southern end to the northern end of a plunger 80, as seen for example in FIG. 1. In another embodiment, the rotator apparatus 10 may be indirectly coupled at its southern end to the northern end of a traveling barrel 106, as seen for example in FIG. 9. The rotator apparatus 10 may be adapted for use with a valve rod or hollow valve rod. If used with a valve rod, the rotator apparatus 10 may be coupled at its northern end to the southern end of a top plunger adapter 90, as seen for example in FIGS. 9 and 10. If used with a hollow valve rod, the rotator apparatus 10 may be coupled at its northern end to the southern end of a hollow valve rod coupler (not shown).

Referring now to FIGS. 2-4B, the north coupling component 12 will be discussed in further detail. The north coupling component 12 may generally comprise an upper threaded region 14, a central non-threaded region 16 having a pair of wrench flats 18 on opposing sides thereof; and a lower threaded region 20. Upper threaded region 14 is adapted to permit the north coupling component 12 to be coupled to a variety of pump components. For example, north coupling component 12 may be coupled to the southern end of top plunger adapter 90. Top plunger adapter 90 may comprise any of various top plunger adapters. Such top plunger adapters may include or be similar to those disclosed in U.S. Pat. No. 7,428,923, which issued on Sep. 30, 2008 to the same Applicant herein, and U.S. Pat. No. 7,713,035, which issued on May 11, 2010 to the same Applicant herein, both of which are incorporated herein by reference. The north coupling component 12 may also be coupled to a hollow valve rod coupler (not shown) in applications utilizing a hollow valve rod. The north coupling component 12 may also be coupled to various other pump components, including standard pump components, as may be needed for particular well conditions and configurations. According to one embodiment, upper threaded region 14 may comprise standard API plunger threading. While in this embodiment upper threaded region 14 is shown as comprising male threading, it should be understood that upper threaded region 14 may comprise either male or female threading, as long as it engages corresponding male or female threading present on the various pump component to which it may be coupled. Lower threaded region 20 is adapted to permit the north coupling component 12 to be coupled to a northern end of the cage 50. While in this embodiment lower threaded region 20 is shown as comprising male threading, it should be understood that lower threaded region 20 may comprise either male or female threading, as long as it engages corresponding male or female threading present on cage 50. Wrench flats 18 are intended to facilitate coupling and de-coupling of the north coupling component 12 to other components of the rotator apparatus 10, as described more fully herein and, as well, to various other pump components including various top plunger adapters and other various pump components, including standard pump components. North coupling component 12 may further include a stop surface 21 positioned at a southern end thereof.

Figure 3:
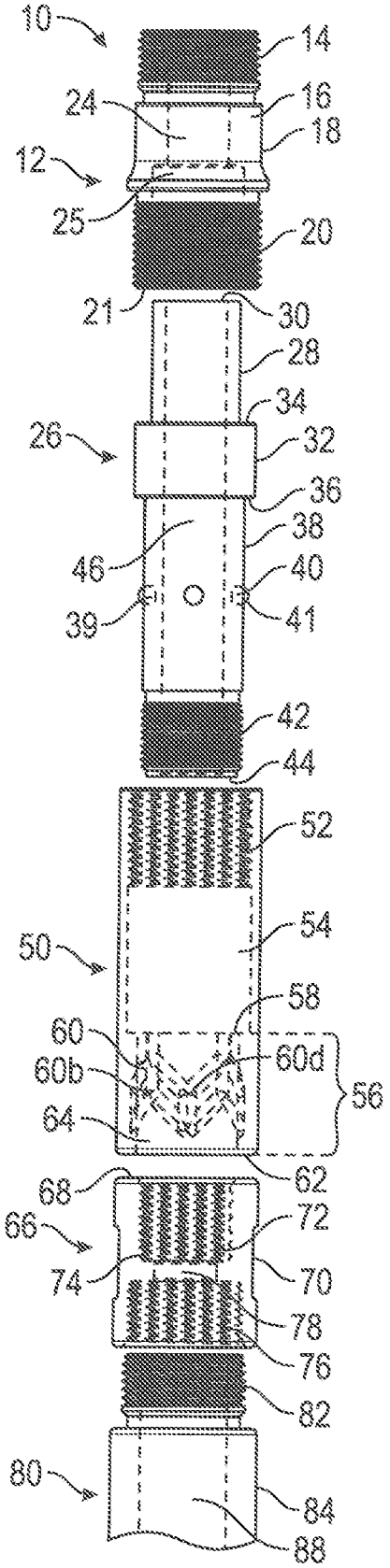
FIG. 3 is a side, exploded view of the rotator apparatus of FIG. 1, with internal portions of the components thereof shown in phantom.

Turning now to the interior of the north coupling component 12, north coupling component 12 may further comprise a stop surface 22, an upper center channel 24, and a lower center channel 25, as shown for example in FIG. 3. Stop surface 22 is adapted to make contact with a northern end of the piston 26, as described more fully herein. Upper center channel 24, which runs through an upper portion of north coupling component 12, is adapted to permit fluids to pass therethrough. Lower center channel 25, which runs through a lower portion of north coupling component 12, is adapted to receive an upper region 28 of the piston 26, as described more fully herein. Upper center channel 24 and lower center channel 25 form a continuous passageway (as seen for example in FIG. 3) and are designed to permit fluids to pass therethrough.

Still referring to FIGS. 2-4B, the piston 26 will be discussed in further detail. The piston 26 may generally comprise an upper region 28, a bushing 32, a lower region 38, and a center channel 46 running therethrough. Upper region 28, as seen in this embodiment, may include an upper flat surface 30 that can make contact with stop surface 22 of the north coupling component 12. Bushing 32 may have an exterior diameter that is greater than an exterior diameter of upper region 28 and an exterior diameter of lower region 38. Bushing 32 may include an upper flat surface 34 and a lower flat surface 36. Upper flat surface 34 can make contact with stop surface 21 of the north coupling component 12, as described more fully herein. Lower region 38 may include a plurality of openings 39 (see FIGS. 4B and 8) into which a plurality of locator pins 40 may be positioned, a threaded region 42, and a lower flat surface 44. Locator pins 40 may protrude outwardly from lower region 38 and are adapted to engage channels or track 60 (hereinafter channels 60) of cage 50, as described more fully herein. It is desired that a height of locator pins 40 correspond to a depth of channels 60. Referring to FIG. 3, piston 26 may include four locator pins 40 corresponding to four openings 39, wherein the respective openings 39 and locator pins 40 may be spaced equidistantly apart from one another. However, it should be understood that any suitable number of openings 39 and locator pins 40 may be used, as may be needed depending upon particular well conditions and configurations. Each locator pin 40 includes a head 41. Head 41 may have a substantially rounded external configuration, as best seen in FIG. 4B. However, head 41 may comprise any other suitable shape, as may be utilized in various conventional locator pins, as long as locator pins 40 engage channels 60. Center channel 46 is adapted to permit fluids to pass therethrough. Threaded region 42 is adapted to permit the piston 26 to be coupled to a northern end of the south coupling component 66. Lower flat surface 44 can make contact with a shoulder 74 of the south coupling component 66, as described more fully herein.

Figure 7:
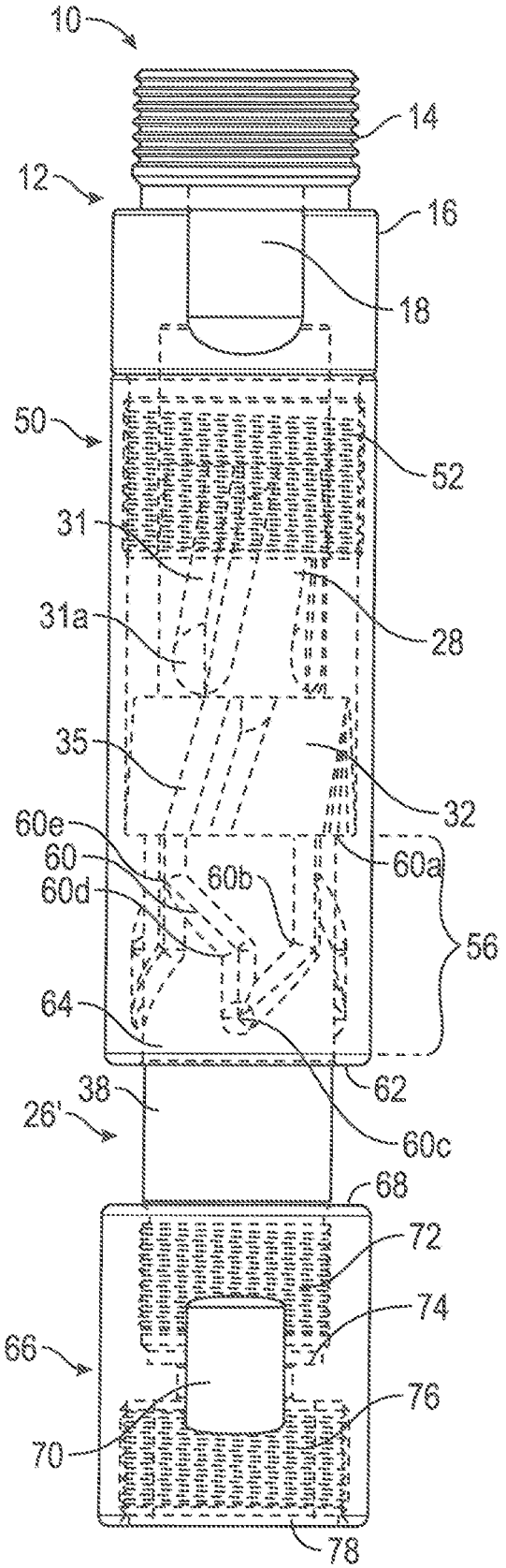
FIG. 7 is a side view of another embodiment of a rotator apparatus in accordance with one or more aspects of the present invention, with internal portions of the components thereof shown in phantom.
Figure 8:
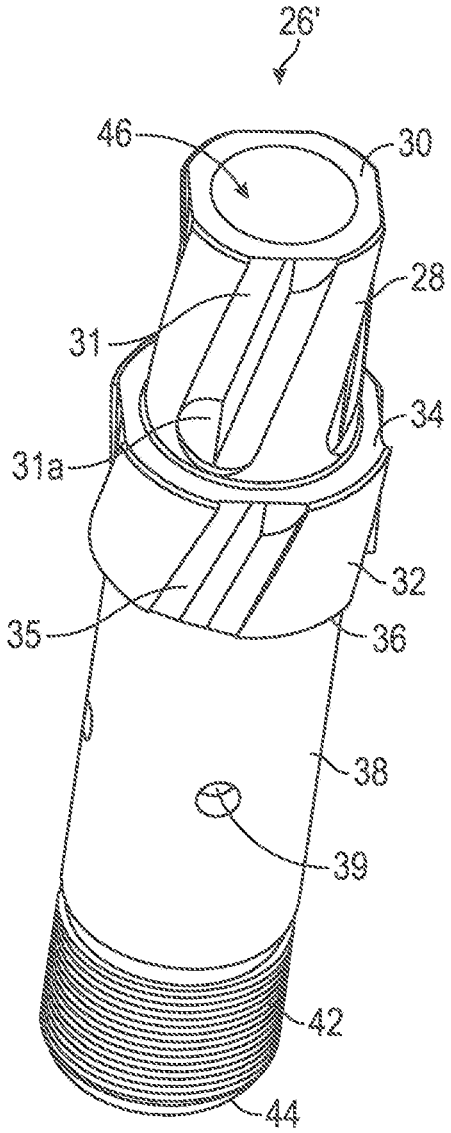
FIG. 8 is a perspective view of an embodiment of a piston portion of the rotator apparatus of FIG. 7.

Referring now to FIGS. 7-8, another embodiment of the piston 26, hereinafter piston 26', is shown. The piston 26' is similar to the piston 26, but includes a plurality of flutes 31 and 35. For this reason, the same reference numbers used in describing the features of the piston 26 will be used when describing the identical features of the piston 26'.

As with the piston 26, the piston 26' may generally comprise an upper region 28, a bushing 32, a lower region 38, and a center channel 46 running therethrough. Upper region 28, as seen in this embodiment, may include an upper flat surface 30 that can make contact with stop surface 22 of the north coupling component 12. In this embodiment, upper region 28 further includes a plurality of flutes 31. The flutes 31 may extend from a lower position proximate upper flat surface 34 of bushing 32 to an upper position proximate upper flat surface 30, terminating at upper flat surface 30. While the number of flutes 31 may be varied, four flutes 31 are preferred. Flutes 31 include openings 31*a* positioned in a lower portion of flutes 31, to permit the passage of pumped fluid from center channel 46 out of the interior of the piston 26' and into an upper portion of the flutes 31. In one embodiment, the flutes 31 may be radial and oriented on an upward (northward) angle. (In one embodiment, for example, the flutes 31 may be oriented on an upward (northward) angle of approximately 45 degrees from horizontal. However, it should be understood that other suitable angles may be employed for the flutes 31, as may be needed for particular well conditions and configurations.) Flutes 31 are preferably spaced equidistantly apart from each other, but could be spaced apart in other configurations.

Bushing 32 may include an upper flat surface 34 and lower flat surface 36. Upper flat surface 34 can make contact with stop surface 21 of the north coupling component 12, as described more fully herein. In this embodiment, bushing 32 further includes a plurality of flutes 35. The flutes 35 may extend from a lower position proximate lower flat surface 36 of bushing 32 to an upper position proximate upper flat surface 34 of bushing 32, terminating at upper flat surface 34. While the number of flutes 35 may be varied, four flutes 35 are preferred. In one embodiment, the flutes 35 may be radial and oriented on an upward (northward) angle. (In one embodiment, for example, the flutes 35 may be oriented on an upward (northward) angle of approximately 45 degrees from horizontal. However, it should be understood that other suitable angles may be employed for the flutes 35, as may be needed for particular well conditions and configurations.) Flutes 35 are preferably spaced equidistantly apart from each other, but could be spaced apart in other configurations. It is preferred that the upward angle of the flutes 35 correspond to the upward angle of the flutes 31.

Lower region 38 may include a plurality of openings 39 into which a plurality of locator pins 40 (see FIGS. 3 and 4B) may be positioned, a threaded region 42, and a lower flat surface 44. Locator pins 40 may protrude outwardly from lower region 38 and are adapted to engage channels 60 of cage 50, as described more fully herein. It is desired that a height of locator pins 40 correspond to a depth of channels 60. Like piston 26, piston 26' may include four locator pins 40 (see FIGS. 3 and 4B) corresponding to four openings 39, wherein the respective openings 39 and locator pins 40 may be spaced equidistantly apart from one another. However, it should be understood that any suitable number of openings 39 and locator pins 40 may be used, as may be needed depending upon particular well conditions and configurations. Each locator pin 40 includes a head 41. Head 41 may have a substantially rounded external configuration, as best seen in FIG. 4. However, head 41 may comprise any other suitable shape, as may be utilized in various conventional locator pins, as long as locator pins 40 engage channels 60. Center channel 46 is adapted to permit fluids to pass therethrough. Threaded region 42 is adapted to permit the piston 26' to be coupled to a northern end of the south coupling component 66. Lower flat surface 44 can make contact with a shoulder 74 of the south coupling component 66, as described more fully herein.

Referring now to FIGS. 2-6, the cage 50 will be discussed in further detail. Cage 50 includes an upper threaded region 52, a middle region 54, a lower channel or track region 56 (hereinafter channel region 56), a flat surface 62, and a center channel 64 running therethrough. Threaded region 52 is adapted to permit coupling of the cage 50 to threaded region 20 of the north coupling component 12. While in this embodiment threaded region 52 is shown as comprising female threading, it should be understood that threaded region 52 may comprise either male or female threading, as long as it engages corresponding male or female threading present on threaded region 20. Middle region 54 is juxtaposed between upper threaded region 52 and channel region 56.

Figure 5:
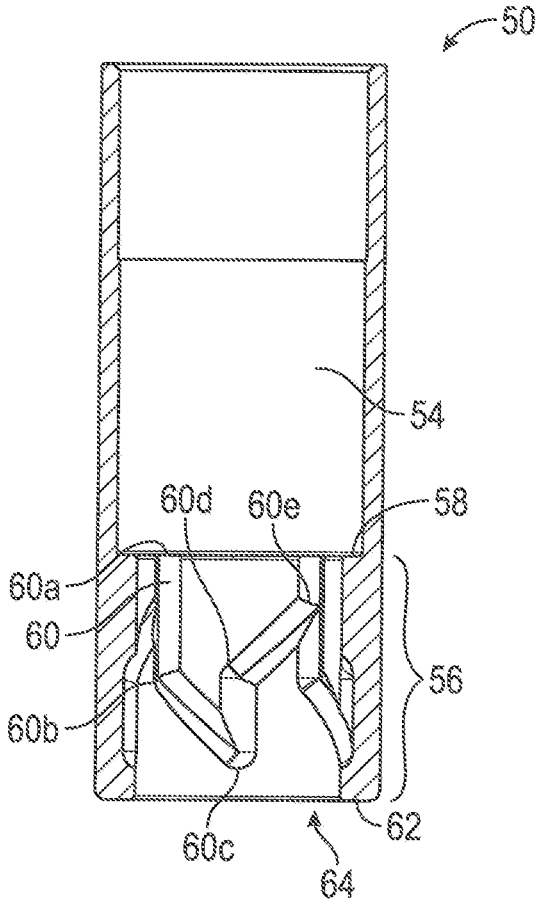
FIG. 5 is a side, partially cut-away view of a cage portion of the rotator apparatus of FIG. 1.
Figure 6:
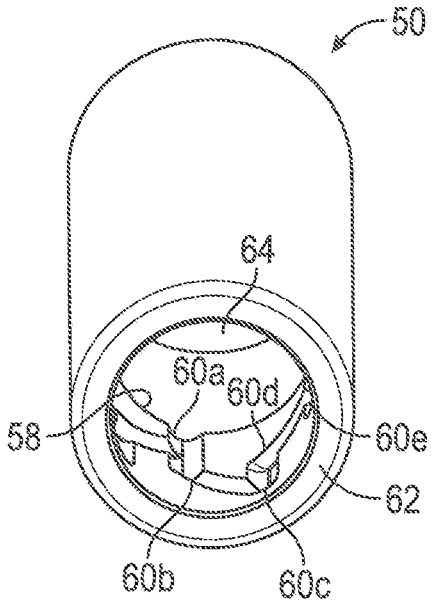
FIG. 6 is bottom perspective view of the cage portion of FIG. 5.

Channel region 56, which is positioned within an interior circumference of cage 50, may include a shoulder 58 and channels 60 formed within channel region 56. As seen in this embodiment, channel region 56 may have a greatest interior diameter that is less than a greatest interior diameter of threaded region 52 and of middle region 54. Beginning from a northern portion of channel region 56, channels 60 will be discussed in further detail. For ease of reference, channels 60 will be described as including regions 60*a*, 60*b*, 60*c*, 60*d*, and 60*e*. Channels 60, which are adapted to receive locator pins 40 of piston 26 or 26', include four points of entry at regions 60*a* through which locator pins 40 may enter channels 60. As can be seen in FIGS. 5-6 for example, regions 60*a* originate at shoulder 58. Regions 60*a* may be spaced equidistantly apart from one another, corresponding to the spacing of the locator pins 40. In this embodiment, four regions 60*a* are provided, corresponding to the four locator pins 40 of the piston 26 or 26'. However, it should be understood that any suitable number of regions 60*a* may be used, as may be needed depending on the number of locator pins 40 employed. As can be seen from a review of FIG. 6, in this embodiment, regions 60*a* and, in turn, channels 60, are substantially arc-shaped and are designed to correspond to the shape of the head 41 of each locator pin 40. However, it should be understood that any other suitable shape may be employed for regions 60*a* and channels 60, as long as they correspond to the shape of the heads 41 of locator pins 40. Continuing southward in the direction of flat surface 62, channels 60 continue beyond regions 60*a* to regions 60*b*. Regions 60*b* may be positioned approximately half-way between shoulder 58 and flat surface 62, as shown in FIGS. 3 and 5. Channels 60 then proceed beyond regions 60*b*, in a southeastward direction, to regions 60*c*. In one embodiment, the angle formed between regions 60*b* and 60*c* relative to flat surface 62 is approximately 45 degrees. From regions 60*c*, channels 60 then continue northward, in the direction of shoulder 58, to regions 60*d*. Regions 60*d* may be positioned approximately half-way between flat surface 62 and shoulder 58, as shown in FIGS. 3 and 5. Channels 60 then proceed beyond regions 60*d*, in a northeastward direction, to regions 60*e*. In one embodiment, the angle formed between regions 60*d* and 60*e* relative to shoulder 58 is approximately 45 degrees. At regions 60*e*, channels 60 then join the next consecutive channel 60 at an area below region 60*a*. It should thus be understood that, below regions 60*a*, channels 60 form a continuous passageway around an interior circumference of the channel region 56. While in this embodiment the angles of the channels 60 formed from regions 60*b* to 60*c*, and from regions 60*d* to 60*e*, respectively, are shown as being approximately 45 degrees, it should be understood that other suitable angles may be employed for the channels 60 between these regions, as may be needed for particular well conditions and configurations.

Referring now to FIGS. 2-4B, flat surface 62 can make contact with an upper surface 68 of the south coupling component 66, as described more fully herein. Center channel 64 is adapted to receive piston 26 or 26' therethrough. When piston 26 or 26' is positioned in the cage 50, locator pins 40 of piston 26 or 26' may engage channels 60 of the cage 50. As seen in FIG. 4B, for example, locator pins 40 extend into channels 60. In operation, locator pins 40 proceed through channels 60. In this way, locator pins 40 guide movement of the piston 26 or 26' within the cage 50. Further, when piston 26 or 26' is positioned in the cage 50, an interior surface of cage 50 and an exterior surface of piston 26 or 26' define fluid cavities 48 and 49 therebetween (as best seen in FIGS. 4A-4B), at middle region 54. In one embodiment, fluid cavities 48 and 49 may each have a length of approximately 0.75 inches. However, it should be understood that fluid cavities 48 and 49 may each have various other lengths that deviate from this dimension, even substantially, as may be needed for different sized plungers that may be coupled to the rotator apparatus 10.

Referring again to FIGS. 2-4B, the south coupling component 66 will be discussed in further detail. The south coupling component 66 may include a flat surface 68 at an upper portion thereof, a pair of wrench flats 70 on opposing sides thereof, an upper threaded region 72, a shoulder 74, a lower threaded region 76, and a center channel 78 running therethrough. Flat surface 68 can make contact with lower flat surface 62 of cage 50, as described more fully herein. Wrench flats 70 are intended to facilitate coupling and de-coupling of the south coupling component 66 to other components of the rotator apparatus 10, as described more fully herein. Threaded region 72 is adapted to permit the south coupling component 66 to be coupled to threaded region 42 of piston 26 or 26'. Shoulder 74 can make contact with lower flat surface 44 of piston 26 or 26', as described more fully herein. Threaded region 76 is adapted to permit the south coupling component 66 to be coupled to a northern end of various pump components, including, for example, a plunger 80, a traveling valve 92 (as seen for example in FIG. 9), a connector 114 (as seen for example in FIG. 10) or other pump component or series of pump components, as may be needed for particular well conditions and configurations. While in this embodiment threaded region 76 is shown as comprising female threading, it should be understood that threaded region 76 may comprise either male or female threading, as long as it engages corresponding male or female threading present on the various pump component to which it may be coupled. Center channel 78 is adapted to permit fluids to pass therethrough.

The construction of the rotator apparatus 10 will now be described in more detail. In one embodiment, the piston 26 or 26' is inserted in the cage 50 with each of the locator pins 40 entering and engaging channels 60 at regions 60*a*. Locator pins 40 may then proceed southwardly through channels 60 to regions 60*e*. At this time, the lower flat surface 36 of bushing 32 is permitted to rest on shoulder 58, such that threaded region 42 is exposed below cage 50. Cage 50 and piston 26 or 26' are positioned above south coupling component 66, with piston 26 or 26' being oriented so that threaded region 42 is proximate threaded region 72 of the south coupling component 66. Threaded region 42 may then be threadably coupled with threaded region 72. Such coupling may be facilitated by the use of wrench flats 70. When the piston 26 or 26', cage 50, and south coupling component 66 are positioned in this manner, it will be seen that piston 26 or 26' is capable of rotating in a clockwise direction while reciprocating southward and northward relative to cage 50 as locator pins 40 engage and proceed through channels 60. Being coupled to piston 26 or 26', south coupling component 66, in turn, is capable of rotating in a clockwise direction as piston 26 or 26' so rotates. North coupling component 12 is positioned above cage 50 and piston 26 or 26' with north coupling component 12 being oriented so that threaded region 20 is proximate threaded region 52 of the cage 50. Threaded region 20 may then be threadably coupled with threaded region 52. Such coupling may be facilitated by the use of wrench flats 18. Southward travel of the piston 26 or 26' relative to the cage 50 is limited by bushing 32, the lower flat surface 36 of which contacts shoulder 58. Northward travel of the piston 26 or 26' relative to the cage 50 is limited by the north coupling component 12, the stop surface 22 of which contacts the upper flat surface 30 of the piston 26 or 26'. Northward travel of the piston 26 or 26' relative to the cage 50 may also be limited by the bushing 32, the upper flat surface 34 of which contacts the stop surface 21 of the north coupling component 12.

Referring now to FIGS. 1-4B, in one embodiment, a southern end of the rotator apparatus 10 may be coupled to a northern end of a pump plunger 80 of an oil pumping system. Plunger 80 may include an upper threaded region 82, an elongated body 84, a lower threaded region 86, and a center channel 88 running therethrough. However, it should be understood that the plunger may comprise various pump plungers, including but not limited to standard pump plungers and other pump plungers as known in the art. The rotator apparatus 10 may be coupled to plunger 80 by positioning south coupling component 66 above plunger 80 with south coupling component 66 being oriented so that threaded region 76 is proximate threaded region 82 of the plunger 80. Threaded region 76 may then be threadably coupled with threaded region 82. Such coupling may be facilitated by the use of wrench flats 70. When the rotator apparatus 10 is fully assembled and coupled to the plunger 80, center channels 24, 46, 78 and 88 are continuous, as can be seen from a review of FIG. 4A, for example, when the rotator apparatus 10 is in a first position. Further, when the rotator apparatus 10 is fully assembled and coupled to the plunger 80, center channels 24, 25, 46, 78 and 88 are continuous, as can be seen from a review of FIG. 4B, for example, when the rotator apparatus 10 is in a second position. A southern end of the pump plunger 80, at lower threaded region 86, may be coupled to a traveling valve (not shown) of an oil pumping system.

Figure 9:
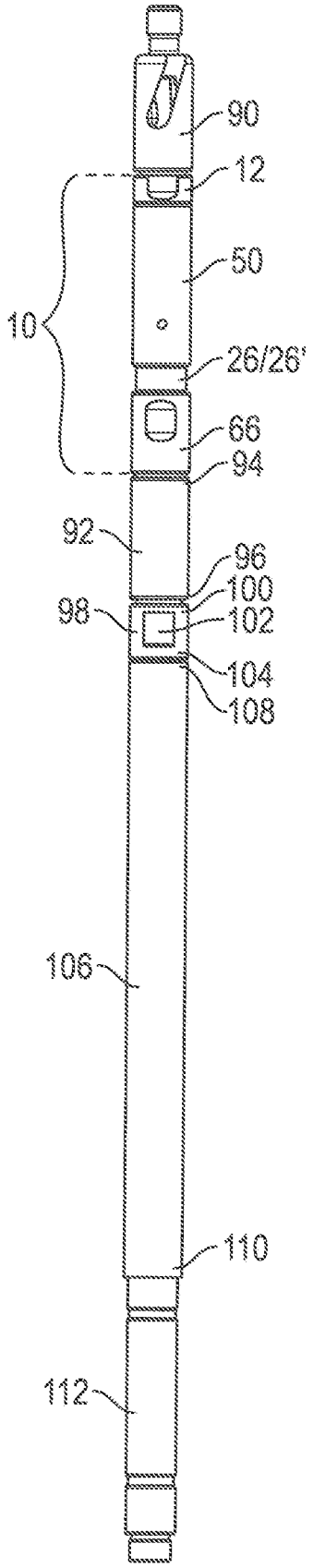
FIG. 9 is a side view of the rotator apparatus of FIG. 1, wherein a northern end of the rotator apparatus is shown coupled to a top plunger adapter and a southern end of the rotator apparatus is shown indirectly coupled to a traveling barrel.

Referring now to FIG. 9, in another embodiment, in pump configurations utilizing a traveling barrel, the rotator apparatus 10 may be indirectly coupled at its southern end to the northern end of a traveling barrel 106 of an oil pumping system. As shown in this embodiment, a traveling valve 92 and a connector 98 may be interposed between rotator apparatus 10 and traveling barrel 106. In this regard, rotator apparatus 10 may be coupled at its southern end to traveling valve 92. Traveling valve 92 may include an upper region 94 and a lower region 96. Upper region 94 may include threading for coupling traveling valve 92 to threaded region 76 of south coupling component 66. Lower region 96 may also include threading.

Connector 98 may be coupled at an upper portion thereof to the lower region 96 of traveling valve 92. Connector 98 may include an upper region 100, a pair of wrench flats 102 on opposing sides thereof, and a lower region 104. Upper region 100 may include threading for coupling connector 98 to lower region 96 of the traveling valve 92. Coupling in this manner may be facilitated by the use of wrench flats 102.

Continuing southward in FIG. 9, traveling barrel 106 may be coupled at an upper portion thereof to connector 98. The traveling barrel 106 may comprise an elongated body having an upper region 108 and a lower region 110. Traveling barrel 106 is preferably hollow and adapted to be reciprocally positioned over a stationary plunger 112. As shown in this embodiment, traveling barrel 106 may be coupled at its upper region 108 to the lower region 104 of connector 98. Upper region 108 may include threading for coupling traveling barrel 106 to lower region 104 of connector 98. Coupling in this manner may be facilitated by the use of wrench flats 102.

Figure 10:
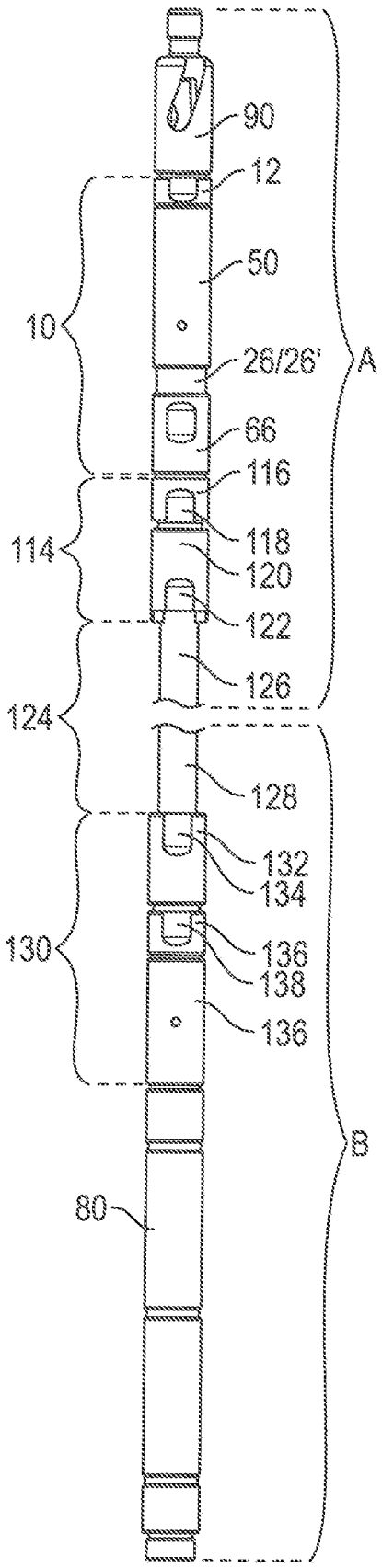
FIG. 10 is a side view of the rotator apparatus of FIG. 1, wherein a northern end of the rotator apparatus is shown coupled to a top plunger adapter and a southern end of the rotator apparatus is shown indirectly coupled to a rod.

Referring now to FIG. 10, in another embodiment, a southern end of the rotator apparatus 10 may be indirectly coupled to a rod 124 of an oil pumping system. As shown in this embodiment, a north connector 114 may be interposed between rotator apparatus 10 and rod 124. In this regard, rotator apparatus 10 may be coupled at its southern end to north connector 114. North connector 114 may include an upper region 116 having wrench flats 118 on opposing sides thereof and a lower region 120 having wrench flats 122 on opposing sides thereof. Upper region 116 may include threading for coupling north connector 114 to threaded region 76 of south coupling component 66. Such coupling may be facilitated by the use of wrench flats 118. Lower region 120 may also include threading.

North connector 114 may be coupled at its lower region 120 to rod 124. Rod 124 may include an upper region 126 and a lower region 128. Upper region 126 may include threading for coupling rod 124 to lower region 120 of the north connector 114. Coupling in this manner may be facilitated by the use of wrench flats 122. Lower region 128 may also include threading. Rod 124 may comprise a rod of various configurations, including a hollow valve rod, a solid valve rod, or a sucker rod.

Continuing southward in FIG. 10, rod 124 may be coupled at its lower region 128 to a south connector 130. South connector 130 may include an upper region 132 having wrench flats 134 on opposing sides thereof and a lower region 136 having wrench flats 138 on opposing sides thereof. Upper region 132 may include threading for coupling south connector 130 to lower region 128 of rod 124. Such coupling may be facilitated by the use of wrench flats 134. A southern portion of lower region 136 may also include threading.

Continuing further southward in FIG. 10, south connector 130 may be coupled at its lower region 136 to plunger 80. Such coupling may be facilitated by the use of wrench flats 138.

Still referring to FIG. 10, it is noted that a first, north region A and a second, south region B are identified. In this embodiment, north region A may generally comprise top plunger adapter 90, rotator apparatus 10, north connector 114, and upper region 126 of rod 124. When positioned within the wellbore, it is preferred that north region A is located inside the tubing but outside (northward) of the barrel. Continuing southward in FIG. 10, south region B may generally comprise lower region 128 of rod 124, south connector 130, and plunger 80. When positioned within the wellbore, it is preferred that south region B is located inside the barrel.

Statement of Operation

Figure 4A:
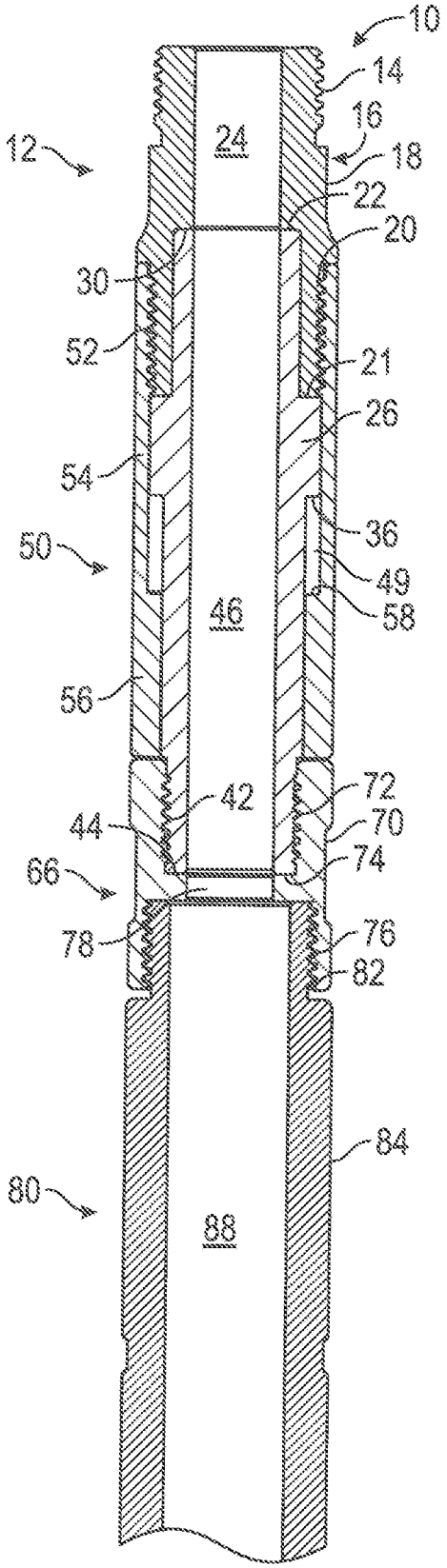
FIG. 4A is a side, cross-sectional view of the rotator apparatus of FIG. 2, taken along line 4-4, in a first position.
Figure 4B:
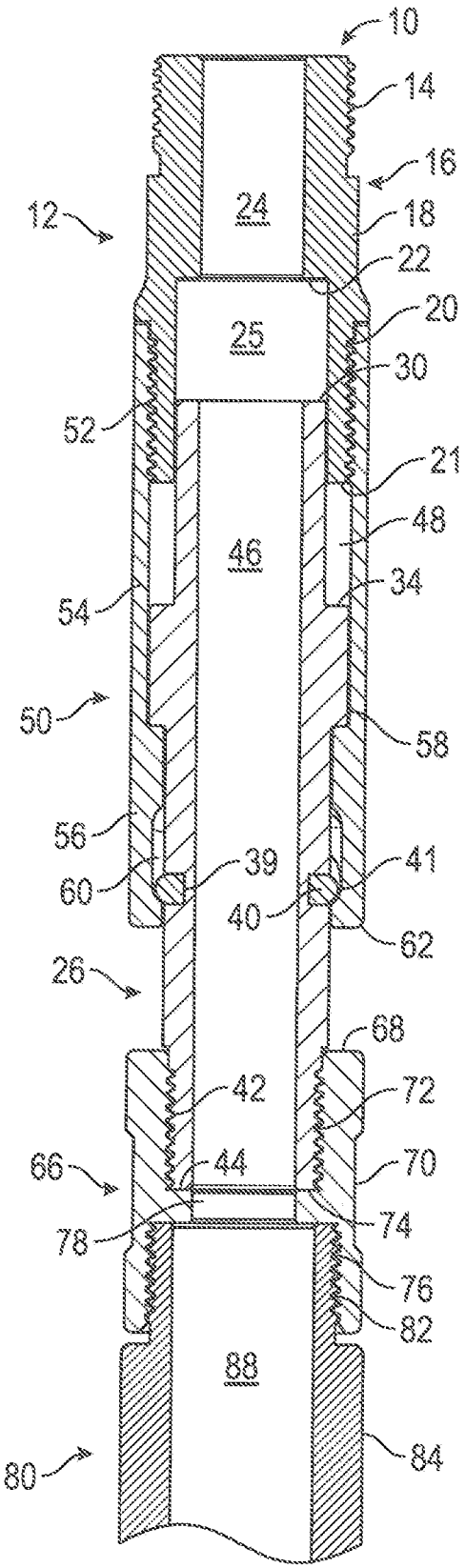
FIG. 4B is a side, cross-sectional view of the rotator apparatus of FIG. 2, taken along line 4-4, in a second position.

FIGS. 4A-4B show a rotator apparatus 10 consistent with one or more embodiments of the present invention. In FIG. 4A, the rotator apparatus 10 is shown during a downstroke. FIG. 4B shows the rotator apparatus 10 during an upstroke.

The rotator apparatus 10 may be coupled, directly or indirectly, to a valve rod or hollow valve rod, so that the rotator apparatus 10 will move up with the upstroke of the pumping unit and down with the downstroke of the pumping unit. A pump operator may determine where to install the rotator apparatus 10, as may be needed for particular well conditions and configurations. For example, in both vertical and horizontal applications, the rotator apparatus 10 may be coupled directly to the plunger 80 (as shown for example in FIG. 1). As another example, in horizontal applications in particular, it may be desired to couple the rotator apparatus 10 to the rod 124 (utilizing a connector, such as north connector 114, as shown in FIG. 10). This would help to prevent the rod 124 (which may be a solid valve rod or hollow valve rod) from wearing out the valve rod guide during the upstroke and downstroke.

In operation, as with a prior art system, fluid (e.g. oil) will pass from a southern region of a pump line to a northern region through a cyclic repetition of upstrokes and downstrokes.

Referring to FIG. 4A, particular attention is directed to the cage 50 and piston 26 or 26' (as shown in FIGS. 7-8). On the downstroke, piston 26 or 26' will move in a northward direction within cage 50, with bushing 32 moving in a northward direction within middle region 54, ultimately contacting stop surface 21. Also during the downstroke, locator pins 40 will move in a northward direction, following channels 60 from regions 60*c* to 60*d* to 60*e*. As this occurs, piston 26 or 26' will rotate an increment in a clockwise direction. In turn, south coupling component 66 will rotate with piston 26 or 26'. This will cause the plunger 80 (or other pump component or series of pump components, such as a traveling valve 92, connector 98, and traveling barrel 106 (as seen for example in FIG. 9), or a north connector 114, rod 124, south connector 130, and plunger 80 (as seen for example in FIG. 10) to which the south coupling component 66 is coupled) to rotate with piston 26 or 26' as well. With respect to the increment of rotation of the piston 26 or 26', in one embodiment, the piston 26 or 26' will rotate approximately one-eighth turn (or 45 degrees) on each downstroke. However, the increment of rotation of the piston 26 or 26' may be varied, by varying the configuration of the channels 60, as may be needed for particular well conditions and configurations.

On the downstroke, fluid that is present in upper fluid cavity 48 will be compressed by bushing 32 and exhausted from the cage 50. The fluid that is exhausted from upper fluid cavity 48 will exit the southern end of the cage 50, through a tolerance formed between the interior of the cage 50 and the exterior of the piston 26 or 26', and will be reintroduced into the main stream of fluid within the tubing. The presence of the fluid in upper fluid cavity 48 and its subsequent exhaustion creates a hydraulic dampening and/or buffering effect, cushioning the downward force of the downstroke. This slows down the northward travel of the piston 26 or 26', providing for soft, gradual movement of the piston 26 or 26', preventing the flat surface 68 of the south coupling component 68 from hammering the flat surface 62 of the cage 50, thereby helping to prevent metal fatigue to the rotator apparatus 10 components and shock impact throughout the pumping system overall. Also on the downstroke, fluid enters through the southern end of the cage 50, through the tolerance formed between the interior of the cage 50 and the exterior of the piston 26 or 26', and is drawn into lower fluid cavity 49.

When piston 26' is used in the rotator apparatus 10, fluid moving through center channel 46 of piston 26' will also pass through openings 31*a* and will move northward through flutes 31. Fluid from fluid cavity 48 will also move southward through flutes 35 as the fluid in fluid cavity 48 is compressed. The angling of the flutes 31 and 35 imparts cyclonic rotation on the fluid as it is pumped which, in turn, enables solids present in the fluid to be suspended in an orbital rotation during pumping operations. This helps to control and redirect the solids, preventing them from becoming lodged between the components of the rotator apparatus 10, thereby preventing potential damage to the components of the rotator apparatus 10 and preventing such components from sticking.

Referring now to FIG. 4B, on the upstroke, piston 26 or 26' (as shown in FIGS. 7-8) will move in a southward direction within cage 50, with bushing 32 moving in a southward direction within middle region 54, ultimately contacting shoulder 58. On the upstroke, the weight of the plunger 80 and the well fluid will cause the locator pins 40 to move in a southward direction, following channels 60 from regions 60*s* to 60*b* to 60*c*. As this occurs, piston 26 or 26' will rotate an increment in a clockwise direction. In turn, south coupling component 66 will rotate with piston 26 or 26'. This will cause the plunger 80 (or other pump component or series of pump components, such as traveling valve 92, connector 98, and traveling barrel 106 (as seen for example in FIG. 9), or north connector 114, rod 124, south connector 130, and plunger 80 (as seen for example in FIG. 10), to which the south coupling component 66 is coupled) to rotate with piston 26 or 26' as well. With respect to the increment of rotation of the piston 26 or 26', in one embodiment, the piston 26 or 26' will rotate approximately one-eighth turn (or 45 degrees) one each upstroke. However, the increment of rotation of the piston 26 or 26' may be varied, by varying the configuration of the channels 60, as may be needed for particular well conditions and configurations.

On the upstroke, fluid that is present in lower fluid cavity 49 will be compressed by bushing 32 and exhausted from the cage 50. The fluid that is exhausted from lower fluid cavity 49 will exit the southern end of the cage 50, through the tolerance formed between the interior of the cage 50 and the exterior of the piston 26, and will be reintroduced into the main stream of fluid within the tubing. The presence of the fluid in lower fluid cavity 49 and its subsequent exhaustion creates a hydraulic dampening and/or buffering effect, cushioning the force of the upstroke. This slows down the southward travel of the piston 26 or 26', providing for soft, gradual movement of the piston 26 or 26', preventing the bushing 32 from hammering the shoulder 58 of the cage 50, thereby helping to prevent metal fatigue to the rotator apparatus 10 components and shock impact throughout the pumping system overall. Also on the upstroke, fluid enters through the southern end of the cage 50, through the tolerance formed between the interior of the cage 50 and the exterior of the piston 26, and is drawn into upper fluid cavity 48. When piston 26' is used in the rotator apparatus 10, fluid from fluid cavity 49 will also move northward through flutes 35 as the fluid in fluid cavity 49 is compressed.

As can be appreciated from the foregoing description, on each downstroke and upstroke, the piston 26 or 26' of the rotator apparatus 10 rotates, causing the south coupling component 66 and plunger 80 (or other pump component or series of pump components to which the rotator apparatus 10 may be coupled, such as traveling valve 92, connector 98, and traveling barrel 106 (as seen for example in FIG. 9), or north connector 114, rod 124, south connector 130, and plunger 80 (as seen for example in FIG. 10) to also rotate. Further, the fluid present in fluid cavities 48 and 49 will be displaced on each downstroke and upstroke, respectively, buffering the impact shock caused by the northward and southward travel of the piston 26 or 26'. It should be noted that the amount of hydraulic dampening provided can be varied, as may be needed for particular well conditions and configurations, by varying the length of the fluid cavities 48 and 49.

With respect to the increment of rotation of the piston 26 or 26' (and, in turn, the south coupling component 66 and plunger 80 (or other pump component or series of pump components to which the rotator apparatus 10 may be coupled, such as traveling valve 92, connector 98, and traveling barrel 106, or north connector 114, rod 124, south connector 130, and plunger 80) during the downstroke and upstroke discussed above, the amount of such increments may vary, based upon the diameter of the plunger and/or barrel to be rotated. Further, the increment of rotation may be designed to address specific well conditions and configurations. For example, the increment of rotation may be varied to address different conditions in which light, moderate, or heavy amounts of solids are present. As another example, the increment of rotation may be varied in situations where extreme wear caused by deviations in the wellbore is a concern.

The rotator apparatus 10 may be adapted to rotate the plunger 80 (or other pump component or series of pump components to which the rotator apparatus 10 may be coupled, such as traveling valve 92, connector 98, and traveling barrel 106, or north connector 114, rod 124, south connector 130, and plunger 80) at various speeds, which will be determined by the well strokes per minute (SPM) based upon the cycles of the pumping system. Thus, with increased SPM, the rotation speed will increase and, with decreased SPM, the rotation speed will decrease.

The rotator apparatus 10 provides several beneficial effects. For example, rotation imparted on the plunger 80 (or other pump component or series of pump components to which the rotator apparatus 10 may be coupled, such as traveling valve 92, connector 98, and traveling barrel 106, or north connector 114, rod 124, south connector 130, and plunger 80) redistributes the solids present in the pumped fluid, thereby preventing the solids from stacking or accumulating in one particular area of the pump's plunger and/or barrel and thus preventing constant wear in one specific area of the pump's plunger and/or barrel. When the solids are moved in this manner, the solids cut in a different area of the pump's plunger and/or barrel at each stroke and, eventually, the solids will break apart. This helps to prevent long-term damage to the pump's plunger and/or barrel. Further, the placement of the rotator apparatus 10 outside of the barrel on the upper region 126 of the rod 124 (see FIG. 10) in deviated or horizontal areas within the wellbore would allow the lower region 128 of the rod 124 (which, as discussed above, may comprise a solid valve rod, hollow valve rod, or sucker rod) located further southward in the wellbore, away from the deviation, to wear more evenly due to the rotation imparted by the rotator apparatus 10. In addition, with the rotation imparted by the rotator apparatus 10, a side motion is created which causes the solids to re-rotate themselves. This rotational movement can fracture the solids, decreasing their size and enabling them to clear out the end of the pump without damaging the plunger and/or barrel.

When the piston 26' is used with the rotator apparatus 10, the flutes 31 and 35 provide at least one additional benefit related to solids control. In this regard, when the pump is not operational, solids present in the fluid will settle. The entrained solids located above the piston 26' should settle directly into a flute 31 or 35. This helps to prevent the solids from becoming lodged between the exterior of the piston 26' and interior of the cage 50, thereby preventing damage to these components and preventing the components from sticking.

Further, since the rotation imparted by the rotator apparatus 10 proceeds in a clockwise direction, this creates a thread-tightening feature, eliminating the potential for pump components to become unscrewed in the event that the plunger 80 (or other pump component or series of pump components to which the rotator apparatus 10 may be coupled, such as traveling valve 92, connector 98, and traveling barrel 106, or north connector 114, rod 124, south connector 130, and plunger 80) were to become stuck and not rotate. Further still, the placement of the rotator apparatus 10 outside of the barrel on the rod string in deviated or horizontal areas within the wellbore will help to prevent the rods from binding up, thereby allowing full rotation to be imparted onto the pump plunger. This is in contrast to presently known rod rotation tools, which are typically placed at the surface and typically rotate the complete rod string. Use of such presently known rod rotation tools can cause the rods to bind up in deviated or horizontal areas of the wellbore. Multiple rotator apparatuses 10 may be incorporated into the pump, as may be needed for particular well conditions and configurations, such as to address troubled areas of deviation within the tubing, for example.

The foregoing description is illustrative of particular embodiments of the invention, but is not meant to be a limitation upon the practice thereof. While embodiments of the disclosure have been described in terms of various specific embodiments, those skilled in the art will recognize that the embodiments of the disclosure may be practiced with modifications without departing from the spirit and scope of the invention.

What is claimed is:

1. A rotator apparatus comprising, in combination:

a north coupling component having an upper region and a lower region, the upper region having an upper channel formed therethrough and the lower region having a lower channel formed therethrough, wherein the upper channel and the lower channel form a continuous passageway;

a piston having an upper region, a lower region, and a channel formed therethrough;

wherein the upper region of the piston is adapted to be reciprocally positioned in the lower channel of the north coupling component;

wherein the piston has a plurality of openings and a plurality of locator pins located in the lower region, wherein each of the plurality of locator pins is positioned in one of each of the plurality of openings;

a cage having an upper region, a lower channel region, and a channel formed therethrough;

wherein the channel region has a plurality of channels adapted to receive the plurality of locator pins;

wherein the cage is adapted to reciprocally receive the piston and to be coupled at the upper region of the cage to the lower region of the north coupling component;

wherein the piston is capable of north, south, and rotational movement relative to the cage;

wherein an interior surface of the cage and an exterior surface of the piston define at least one fluid cavity therebetween; and a south coupling component having an upper region, a lower region, and a channel formed therethrough, and adapted to be coupled at the upper region of the south coupling component to the lower region of the piston.

2. The rotator apparatus of claim 1 further comprising:

an exterior threaded region positioned on the lower region of the piston; and an interior threaded region positioned on the upper region of the south coupling component;

wherein the interior threaded region is adapted to be threadably coupled with the exterior threaded region at the lower region of the piston.

3. The rotator apparatus of claim 1 further comprising:

an exterior threaded region positioned on the lower region of the north coupling component; and an interior threaded region positioned on the upper region of the cage;

wherein the interior threaded region is adapted to be threadably coupled with the exterior threaded region at the lower region of the north coupling component.

4. The rotator apparatus of claim 1 wherein the piston further comprises a plurality of flutes located on an exterior portion of the upper region of the piston, wherein a lower portion of each of the plurality of flutes is open to an interior of the piston, and wherein each flute of the plurality of flutes is adapted to permit fluid to flow therethrough.

5. The rotator apparatus of claim 4 wherein each of the plurality of flutes is oriented radially around the upper region.

6. The rotator apparatus of claim 1 wherein the piston further comprises a bushing located between the upper region and lower region of the piston.

7. The rotator apparatus of claim 6 wherein the piston further comprises a plurality of flutes located on an exterior portion of the bushing, wherein each flute of the plurality of flutes is adapted to permit fluid to flow therethrough.

8. The rotator apparatus of claim 7 wherein each of the plurality of flutes is oriented radially around the bushing.

9. A rotator apparatus comprising, in combination:

a north coupling component having an upper region and a lower region, the upper region having an upper channel formed therethrough and the lower region having a lower channel formed therethrough, wherein the upper channel and the lower channel form a continuous passageway;

wherein the lower region of the north coupling component has an exterior threaded region;

a piston having an upper region, a bushing, a lower region, and a channel formed therethrough;

wherein the upper region of the piston is adapted to be reciprocally positioned in the lower channel of the north coupling component;

wherein the lower region of the piston has an exterior threaded region;

wherein the piston has a plurality of openings and a plurality of locator pins located in the lower region, wherein each of the plurality of locator pins is positioned in one of each of the plurality of openings;

a cage having an upper region, a lower channel region, and a channel formed therethrough;

wherein the upper region of the cage has an interior threaded region, adapted to be threadably coupled with the exterior threaded region at the lower region of the north coupling component;

wherein the channel region has a plurality of channels adapted to receive the plurality of locator pins;

wherein the cage is adapted to reciprocally receive the piston and to be coupled at its the upper region of the cage to the lower region of the north coupling component;

wherein the piston is capable of north, south, and rotational movement relative to the cage;

wherein an interior surface of the cage and an exterior surface of the piston define a plurality of fluid cavities therebetween; and a south coupling component having an upper region, a lower region, and a channel formed therethrough, and adapted to be coupled at its the upper region of the south coupling component to the lower region of the piston; and wherein the upper region of the south coupling component has an interior threaded region, adapted to be threadably coupled with the exterior threaded region at the lower region of the piston.

10. The rotator apparatus of claim 9 wherein the piston further comprises a plurality of flutes located on an exterior portion of the upper region of the piston, wherein a lower portion of each of the plurality of flutes is open to an interior of the piston, and wherein each flute of the plurality of flutes is adapted to permit fluid to flow therethrough.

11. The rotator apparatus of claim 10 wherein each of the plurality of flutes is oriented radially around the upper region.

12. The rotator apparatus of claim 9 wherein the piston further comprises a plurality of flutes located on an exterior portion of the bushing, wherein each flute of the plurality of flutes is adapted to permit fluid to flow therethrough.

13. The rotator apparatus of claim 12 wherein each of the plurality of flutes is oriented radially around the bushing.

14. A method for rotating a pump component comprising the steps of:

providing a rotator apparatus comprising, in combination:

a north coupling component having an upper region and a lower region, the upper region having an upper channel formed therethrough and the lower region having a lower channel formed therethrough, wherein the upper channel and the lower channel form a continuous passageway;

a piston having an upper region, a bushing, a lower region, and a channel formed therethrough;

wherein the upper region of the piston is adapted to be reciprocally positioned in the lower channel of the north coupling component;

wherein the piston has a plurality of openings and a plurality of locator pins located in the lower region, wherein each of the plurality of locator pins is positioned in one of each of the plurality of openings;

a cage having an upper region, a lower channel region, and a channel formed therethrough;

wherein the channel region has a plurality of channels adapted to receive the plurality of locator pins;

wherein the cage is adapted to reciprocally receive the piston and to be coupled at the upper region of the cage to the lower region of the north coupling component;

wherein the piston is capable of north and south and rotational movement relative to the cage;

wherein an interior surface of the cage and an exterior surface of the piston define an upper fluid cavity and a lower fluid cavity therebetween; and a south coupling component having an upper region, a lower region, and a channel formed therethrough, and adapted to be coupled at its the upper region of the south coupling component to the lower region of the piston;

coupling the rotator apparatus at its the south coupling component to at least one pump component;

causing the piston to move in a northward direction relative to the cage;

during the movement of the piston in the northward direction, causing the piston to rotate an increment;

during the movement of the piston in the northward direction, causing the south coupling component and the at least one pump component to rotate an increment during the incremental rotation of the piston;

causing the piston to move in a southward direction relative to the cage;

during the movement of the piston in the southward direction, causing the piston to rotate an increment; and during the movement of the piston in the southward direction, causing the south coupling component and the at least one pump component to rotate an increment during the incremental rotation of the piston.

15. The method of claim 14 wherein the at least one pump component is a plunger.

16. The method of claim 14 wherein the at least one pump component comprises:

a traveling valve having an upper region and a lower region, wherein the upper region of the traveling valve is coupled to the lower region of the south coupling component;

a connector having an upper region and a lower region, wherein the upper region of the connector is coupled to the lower region of the traveling valve; and a traveling barrel having an upper region and a lower region, wherein the upper region of the traveling barrel is coupled to the lower region of the connector.

17. The method of claim 14 wherein the at least one pump component comprises:

a north connector having an upper region and a lower region, wherein the upper region of the north connector is coupled to the lower region of the south coupling component;

a rod having an upper region and a lower region, wherein the upper region of the rod is coupled to the lower region of the north connector;

wherein the rod is one of a hollow valve rod, solid valve rod, and sucker rod;

a south connector having an upper region and a lower region, wherein the upper region of the south connector is coupled to the lower region of the rod; and a plunger coupled to the lower region of the south connector.

18. The method of claim 14 wherein the piston further comprises a plurality of flutes located on an exterior portion of the upper region of the piston, wherein a lower portion of each of the plurality of flutes is open to an interior of the piston, and wherein each flute of the plurality of flutes is adapted to permit fluid to flow therethrough.

19. The method of claim 14 wherein the piston further comprises a plurality of flutes located on an exterior portion of the bushing, wherein each flute of the plurality of flutes is adapted to permit fluid to flow therethrough.

20. The method of claim 14 further comprising the steps of:

during the movement of the piston in the northward direction, drawing fluid into the lower fluid cavity;

during the movement of the piston in the northward direction, pushing fluid out of the upper fluid cavity;

during the movement of the piston in the southward direction, drawing fluid into the upper fluid cavity; and during the movement of the piston in the southward direction, pushing fluid out of the lower fluid cavity.

* * * * *